US008506426B2

(12) United States Patent
Perez

(10) Patent No.: US 8,506,426 B2
(45) Date of Patent: Aug. 13, 2013

(54) GAME OF LOBOL

(75) Inventor: Gabriel Perez, Maywood, NJ (US)

(73) Assignee: Fly Boy Games, LLC, Maywood, NJ (US)

( * ) Notice: Subject to any disclaimer, the term of this patent is extended or adjusted under 35 U.S.C. 154(b) by 339 days.

(21) Appl. No.: 13/023,731

(22) Filed: Feb. 9, 2011

(65) Prior Publication Data

US 2011/0195806 A1 Aug. 11, 2011

Related U.S. Application Data

(60) Provisional application No. 61/303,398, filed on Feb. 11, 2010.

(51) Int. Cl.
*A63B 67/00* (2006.01)

(52) U.S. Cl.
USPC ..... 473/415; 473/470

(58) Field of Classification Search
USPC ..... 273/118 R, 119 R, 398–402; 473/3, 473/23, 54, 415, 465, 470, 471
See application file for complete search history.

(56) References Cited

U.S. PATENT DOCUMENTS

| | | | | |
|---|---|---|---|---|
| 1,757,870 | A * | 5/1930 | Mahr | 273/123 R |
| 3,746,340 | A * | 7/1973 | Ellis | 473/471 |
| 3,920,245 | A | 11/1975 | Gothreaux et al. | |
| 4,211,413 | A | 7/1980 | Arzola | |
| 4,352,497 | A | 10/1982 | Warehime | |
| 4,687,208 | A * | 8/1987 | Thomas | 473/470 |
| 5,104,130 | A * | 4/1992 | Francin | 273/348 |
| 5,125,669 | A * | 6/1992 | Kanda | 273/348 |
| 5,735,749 | A * | 4/1998 | Charbel et al. | 473/3 |
| 5,827,138 | A * | 10/1998 | Barrett | 473/470 |
| 6,045,466 | A | 4/2000 | Suess | |
| 6,849,010 | B1 | 2/2005 | Valdeus, Jr. | |
| 6,988,964 | B2 | 1/2006 | Buckfield | |
| 7,371,194 | B2 | 5/2008 | Babiak et al. | |
| 7,582,029 | B2 | 9/2009 | Nikiema et al. | |
| 8,177,233 | B2 * | 5/2012 | Grayson | 273/118 R |

(Continued)

FOREIGN PATENT DOCUMENTS

| | | | |
|---|---|---|---|
| UA | 0008545 | U | 8/2005 |
| UA | 0009001 | U | 9/2005 |

(Continued)

*Primary Examiner* — Mark Graham
(74) *Attorney, Agent, or Firm* — Gearhart Law, LLC

(57) ABSTRACT

A method of playing a game called lobol, and a kit to facilitate playing it. The lobol is a small, solid ball. In addition to the lobol, the game requires one or more larger balls. A third element of equipment is a goal that has an opening large enough to admit the lobol, but small enough to exclude the larger ball. The game is played by placing the lobol on a playing field between a starting point and the goal enclosure. One player is designated as the "player in possession". That player propels one of the balls towards the lobol with the intention of moving the lobol into the goal, thereby scoring a goal. The player in possession continues throwing the ball at the lobol, until they miss. The other player then takes over as the player in possession, and they attempt to move the lobol into the goal.

10 Claims, 4 Drawing Sheets

(56) References Cited

U.S. PATENT DOCUMENTS

| | | | |
|---|---|---|---|
| 2002/0137580 | A1 | 9/2002 | Hodge et al. |
| 2003/0236138 | A1 | 12/2003 | Murchison |
| 2006/0189416 | A1 | 8/2006 | Nelson |
| 2007/0010352 | A1 | 1/2007 | Santha |
| 2007/0072702 | A1 | 3/2007 | Lion |
| 2009/0134580 | A1 | 5/2009 | Lessack |
| 2009/0143173 | A1 | 6/2009 | Maki-Petaja et al. |

FOREIGN PATENT DOCUMENTS

| | | | |
|---|---|---|---|
| WO | WO 98/02215 | A1 | 1/1998 |
| WO | WO 98/11962 | A1 | 3/1998 |
| WO | WO 2006/006890 | A3 | 1/2006 |
| WO | WO 2008 018884 | A1 | 2/2008 |
| WO | WO 2009 008995 | A1 | 1/2009 |

* cited by examiner

GAME OF LOBOL

CLAIM OF PRIORITY

This application claims priority to U.S. Ser. No. 61/303,398 filed Feb. 11, 2010, the contents of which are fully incorporated herein by reference.

FIELD OF THE INVENTION

The invention relates to a kit and method of engaging in a fun physical activity, in particular, a field game.

BACKGROUND OF THE INVENTION

The invention relates to a kit and method of using said kit to engage in a recreational or conditioning activity. The activity is a game that preferably involves a substantially level and smooth playing area, a number of balls and a goal scoring area. The game may serve to challenge and improve a person's marksmanship, precision of motions, balance, and strategic planning of next moves. The personified game also aims to reduce or eliminate the need for physical contact between players of the same or opposing teams. Physical contact serves to provide an additional element of excitement to a spectator sport, but often leads to more injuries than any other factor. The present invention is novel and distinct, since it may be played outdoors or indoors, irrespective of the type or size of the playing surface.

The present invention is a team sport that does not require a large number of people or a large playing area. This may be highly desirable since the majority of social or familial gatherings are too small to man commonly played team sports, such as soccer or softball, or volleyball. Traditional team sports require a large number of players and a relatively large playing area, to provide an optimal playing experience. Not having the requisite number of players forces players to bend the rules, compromise on quality of play and reduce sizes of the preferred playing areas, all of which detract from the quality of the game. On the other hand, the present invention may preferably be played by two teams comprised of at least one player each. Since there may be at least one ball per player, participants are able to compensate for fewer players, by introducing additional balls or by reducing or increasing the playing field proportions.

DESCRIPTION OF THE RELATED ART

U.S. Pat. No. 6,849,010 discloses a hand ball game and method that comprises an elongated rectangular playing field having two opposite ends. A ground standing tubular goal net at both ends of the playing field. The goal net is approximately 12 feet in diameter and 3½ feet tall and has a goalkeeper playing within it. Two teams of five to seven players attempt to get the ball into the opponents goal net.

US Patent Application No. 2006/0189416 discloses a soccer (or association football) goalkeeping game has two players playing against each other on a reduced-sized playing field. Each players has as objectives not only to score on the opponent but also save the opponent's shot on goals. The rules of play reward goalkeeping play in particular. For example, a player who saves a goal shot but knocks the ball out-of-bounds on his or her side of the field get the ball back, instead of losing the ball pursuant to FIFA rules of soccer (or association football). Also, not only do goals earn points but so do caught-and-held saves, and there is no counterpart whatsoever to points for caught-and-held saves under FIFA rules of soccer (or association football).

US Patent Application No. 2007/0072702 teaches a new sport of Toeball, similar in many respects to soccer (American) and futbol (International), but with important evolutionary changes that make it something radical and new. In Toeball, the field has new markings, and the goal stands partially blocked off by a "bounce board" around the edges. In Toeball, we have only 10 players on the field at any one time because there is no goalkeeper—nor is there an offside penalty. Shots from the field count for two or three points, and foul shots count for one point, like basketball. Teams must shoot the ball within 40 seconds of when they take possession, or lose possession. Referees are required to make foul calls whenever one player initiates contact against another player, which makes toeball a much gentler game than the game of soccer. When making an in-bounds pass, players can kick the ball in or throw it in. There are no corner kicks. The clock stops on every referee whistle and does not start again until an inbounds player touches the ball. Finally, in toeball, there are four 15-minute quarters, teams can call multiple time outs in each quarter, and teams can make substitutions from the bench with much greater frequency than in the sport of soccer. The combination of a few radical new rules changes, plus the additional of many evolutionary rules changes add up cumulatively to a completely new and original sport worthy of a patent in its own right.

Various implements are known in the art, but fail to address all of the problems solved by the invention described herein. One embodiment of this invention is illustrated in the accompanying drawings and will be described in more detail herein below.

SUMMARY OF THE INVENTION

The present invention relates to a method of playing a game called lobol, and a kit to facilitate playing the game.

In a preferred embodiment, the lobol is a small, solid ball that may, for instance, be spherical in shape and evenly weighted. The lobol preferably has a size in a range between 2 and 3 inches in diameter and may be made of a hard, substantially unyielding material such as, but not limited to, a phenolic resin, polyester or clear acrylic.

In addition to the lobol, there are one or more larger balls. These larger balls are preferably spherical in shape, evenly weighted, and have a size in a range of between 3.5 and 6 inches in diameter. The larger balls are preferably comprised of a resilient, but yielding material such as, but not limited to, rubber or silicone.

A third element of equipment is a goal enclosure. The goal enclosure is preferably shaped to have an opening sized to admit the lobol, but not the larger ball.

In a simple, preferred embodiment of the invention, two players may designate starting point at a selected distance from where the goal enclosure has been placed. The lobol may be placed on the playing field between the starting point and the goal enclosure.

The two players then designate one of them as being player in possession of the lobol. The player in possession may then throw, or propel, one of the balls towards the lobol with the intention of making the lobol move towards and into the goal enclosure.

Depending on the outcome of that action, one of the following steps may be take.

If the ball misses the lobol, the other player may become the player in possession, and attempt to move the lobol into the goal enclosure by propelling one of the balls towards it. In a preferred embodiment, each player has a goal enclosure, and each player may attempt to move the lobol into the others goal enclosure.

If the ball hits the lobol it enters the goal enclosure, a goal is recorded as being scored. The players may then designate which of them will assume the role of "player in possession". The player in possession may then select a ball and propel it towards the lobol, as described above.

If the ball hits the lobol, but does not make it enter a goal enclose, the player remains the player in possession and has another chance to throw a ball towards the lobol. In a preferred embodiment, designating which player is the "player in possession" may be done by means of a faceoff. The faceoff may begin with the lobol being placed on the playing field. The two players may then position themselves substantially equidistant from the lobol. The players may also be on opposite sides of the lobol, substantially 180 degrees apart from each other.

On a predetermined signal, both players may simultaneously propel one of the balls at the lobol. The role of player in possession may then be decided according to the following logic.

If one of the players manages to propel the lobol into a goal enclosure, they become the player in possession. If that does not occur, then whichever player propels the lobol furthest away from themself is designated. And if neither player hits the lobol, then whichever player's ball lands closest to the lobol is designated.

The game kit preferably contains at least one goal enclosure, a lobol, and at least two balls. The game kit may also contain side and corner limits, as well as field markers.

Therefore, the present invention succeeds in conferring the following, and others not mentioned, desirable and useful benefits and objectives.

It is an object of the present invention to provide a new and entertaining team sport.

It is another object of the present invention to provide a form of team sport that may be played by teams comprised of one or more people.

Yet another object of the present invention is to provide a recreational activity that sharpens one's marksmanship, balance, and strategy.

Still another object of the present invention is to provide a recreational activity that can be simply and expeditiously transported and set up.

Still another object of the present invention is to provide a recreational team sports that aims to avoid physical contact between players.

Yet another object of the present invention is to provide a game that is simple to play, and thus can be enjoyed even by those who are unfamiliar with its rules.

Still another object of the present invention is to provide a team sport that may be equally entertaining whether few or many participate.

DESCRIPTION OF THE PREFERRED EMBODIMENTS

Figure 1:
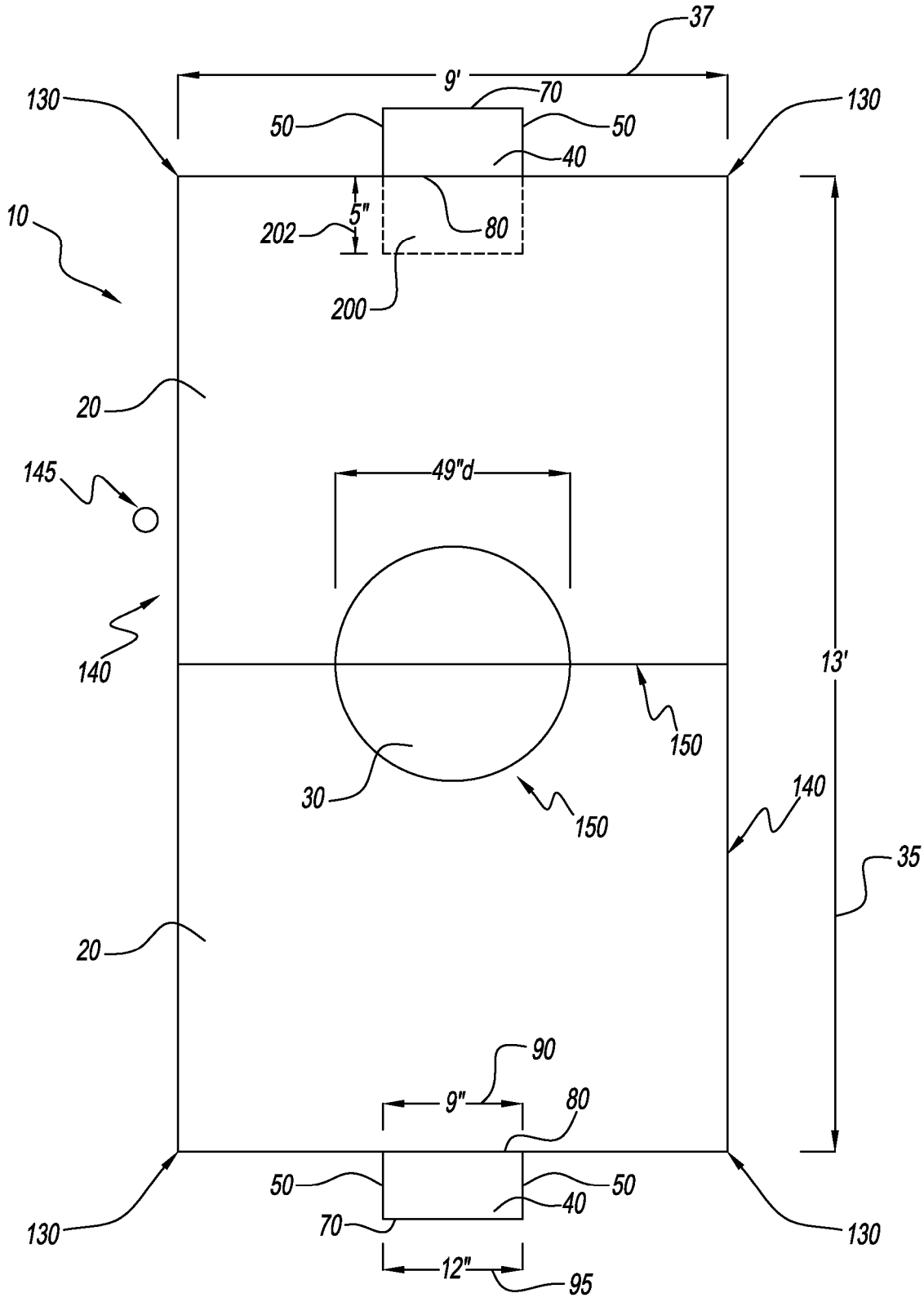
FIG. 1 is a diagram of the preferred playing surface.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1, shown is a diagram of the preferred playing field for the present invention. Shown are a playing field 10, playing field half 20, mid-field marker 30, a field length 35, a field width 37, a goal enclosure 40, posts 50, a back wall 70, an opening 80, a width 90, corner limits 130, side limits 140, and a field marker 150.

The playing field 10 preferably contains two halves 20 of equal size. The preferred width of the playing field 37 may be between 9 feet and to 18 feet, while the preferred length 35 may be between 13 feet and 26 feet. While there is no preferred ratio of field width 37 to field length 35, it may be preferable for the length 35 to be at least 4 feet longer than the width 35. It may be preferable to create a solid line field marker 150 to separate the two halves 20 of the playing field 10.

The side limits 140 denote the meets and bounds of the playing field 10. When viewed from overhead, the side limits 140 create a rectangle, with the inside area representing the playing field 10. The area outside the side limits 140 may be qualified as out-of-bounds area 145. Balls 120 or the lobol 110 (FIG. 4) that land in the out-of-bounds 145 area during play, must be thrown in, or in-bounded, in order for the play to continue. Additionally, the playing field 10 preferably contains four corner limits 130 that describe locations where perpendicular side limits 140 converge. The corner limits 130 preferably represent special in-bounds locations from which an offensive in-bounds may be made towards an opponent's goal enclosure.

Corner limits 130 or side limits 140 may be added to the game kit containing the other component of the present invention. Alternatively a separate kit for may be formed for these items or participants may improvise using any other available objects or materials. The preferred embodiment for the corner limits 130 is in the form of a flag 135, similar to a flag 135 shown in FIG. 4. The corner limit 130 may be a colored or plain rod or pipe. The corner limit 130 may be designated using a triangular like shape that may laid down in the corners of the playing field 10 using rope ribbon or paint.

The side limits 140 are preferably rope or cordage. The rope or cordage may be provided in the game kit and have different sizes, such that two segments of the rope may be at least 13 feet for the length 35 side limits 140, and two other segments of the rope at least 9 feet in length for the width 37 side limits 140. The area of the width 37 side limit 140 that forms a part of the goal opening 80, may be painted with a different color, such as yellow. The rope or cordage may also be a single length, roll or spool of cordage for the entire perimeter of the lobol pitch 10. The side limit 140 may be laid out on the ground or floor, or it may be suspended in the air from posts, rods, or other supports. Alternatively, the side limits 140 may also spray painted, rolled on, or chalked down. Field markers, such as the mid field marker may also be created using a rope, paint, or chalk. Materials for side limits 140 may be selected from, but not limited to natural fibers such as manila hemp, hemp, linen, cotton, coir, jute, and sisal; or synthetic fibers, such as polypropylene, nylon, or polyesters, for example, PET, LCP, HPE, Vectran, polyethylene Aramids (e.g. Twaron, Technora and Kevlar) and polyaramids (e.g. Dralon, Tiptolon). Some ropes are constructed of mixtures of several fibres or use co-polymer fibres. Side limit 140 may also be made out of metal, silk, wool, hair or Rayon.

The mid-field marker 30 may be placed in the mid point of the playing field and may designate a faceoff area. The mid-field marker 30 is shown to be circular in shape, but may instead be in any other shape. The preferred width 32 of the field marker 30 may be between 12 and 50 inches. The faceoff initiates play, therefore it is preferable that at the start of play or after a goal has been scored that play begins equidistant from the two goal enclosures 40.

The playing field 10 may preferably be situated on substantially level ground, such as packed earth, sand, dirt or clay. The present invention may also be played on asphalt, concrete, tarp, Astroturf, or a grassy surface, where the grass has been cut short, such as a putting green or a fairway of a golf course. The playing field 10 may also be on a slight slant, especially if played over rougher surfaces. The present invention affords this flexibility because the lobol 110 and the balls 120 are preferably small and heavy when considering their size. Therefore, when playing in a slanted or uneven surface, a ball 120 or a lobol 110 will not roll on its own, or will be prevented from doing so but the uneven terrain.

Figure 2:
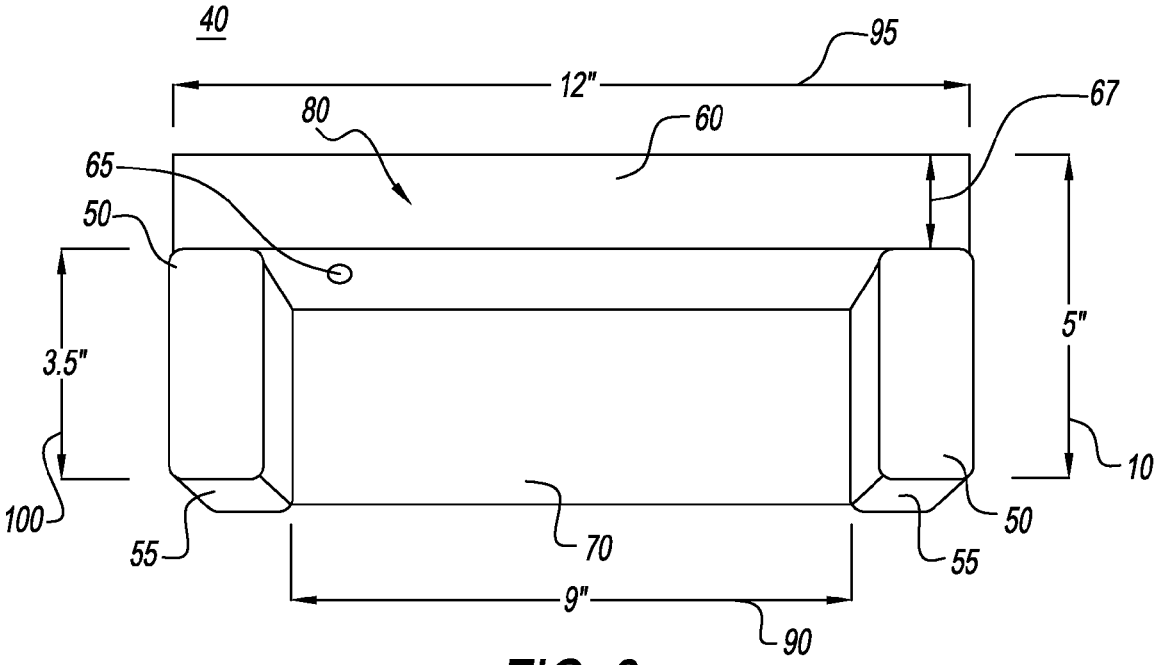
FIG. 2 is the front view of the goal.
Figure 3:
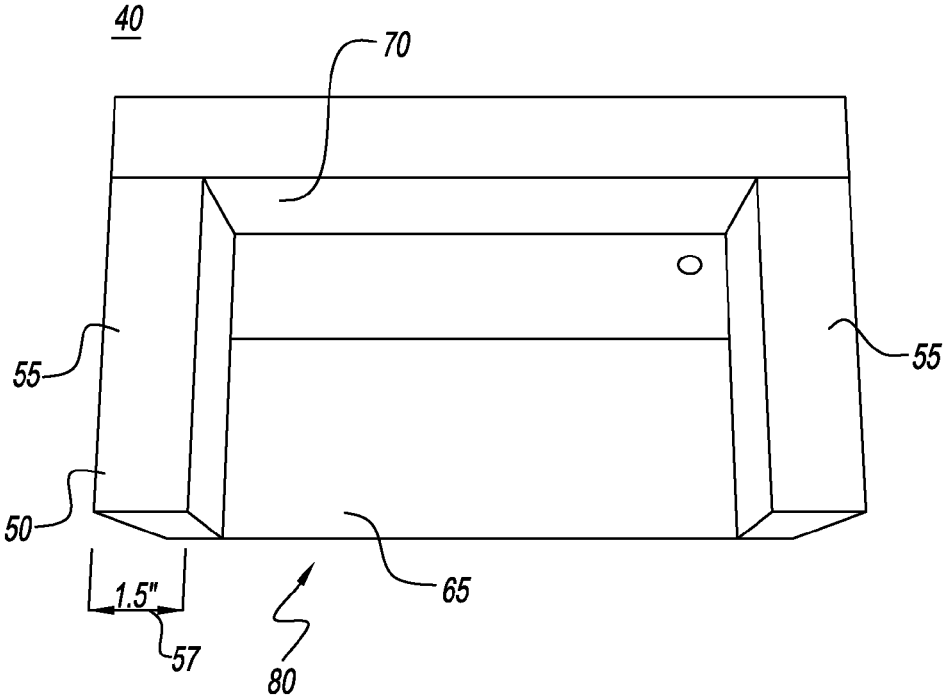
FIG. 3 is an underside of the goal.
Figure 4A:
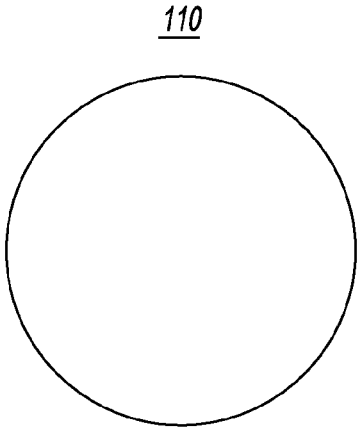
FIG. 4 is a diagram of the preferred equipment.
Figure 4B:
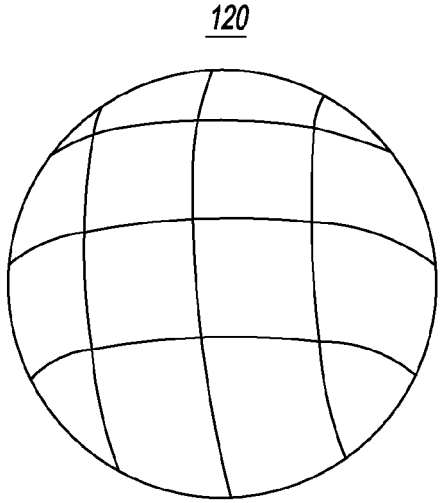
Figure 4C:
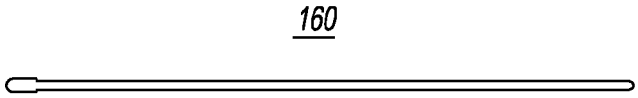
Figure 4D:
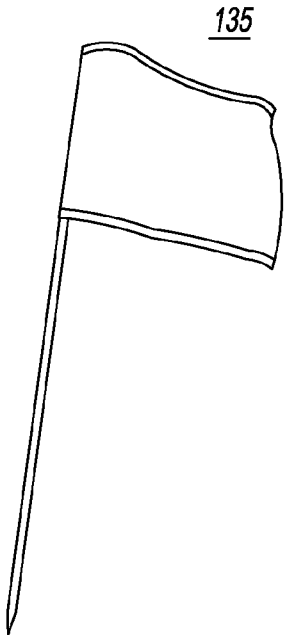

FIGS. 2 and 3 illustrate the different angles of the goal enclosure 40. Shown are a goal enclosure 40, posts 50, a bottom surface 55, a width of post 57, a cross bar 60, a top of goal 65, a back wall 70, an opening 80, a width 90, a length 95, a height 100, and an overall height 105.

Preferably the present invention may be played with no more than two goal enclosures 40. However, a single goal enclosure may service both teams, with both teams switching roles of an opponent or a defendant. When a single goal enclosure 40 is used, it may be preferable that the previously defending team that now comes into possession of the lobol 110 may begin play only from an agreed upon point of the playing field 10, such as a mid-field field marker 150.

The goal enclosure 40 contains an opening 80 that is large enough to admit a lobol 110. The opening 80 is preferably framed by two posts 50 and a cross bar 60. The opening 80 may be placed directly on top of and parallel to the side limit 140 that marks the field width 37. Preferably, there may an equal distance between each post 50 and the corner limit 130 that is located at each end of the particular side limit 140, such that the goal enclosure 40 is located substantially in the middle of the side limit 140. In some cases, play may take place over wide and short playing fields or over square playing fields 10, it would then follow that the goal enclosure 40 may be also be placed along the field length 35. In another alternative, the goal enclosure 40 may be placed at any point along the side limits 140, as long as the two goal enclosures end up on opposite sides of the playing field 10. The length of the side limit 140 that forms the bottom boundary of the opening 80, may also be referred to as the goal line, or the scoring line, or the out-of-bounds line, or any other term in the art used to describe a scoring threshold.

The posts 50 may preferably be between 3 and 6 inches in height 100 and between 5 and 7.5 inches in overall height 105. Overall height 105 refers to the height 100 plus the width 67 of the cross bar 60. Alternatively, the goal enclosure 40 may be limited to two posts 50 that may be embodied in poles, posts, markers or cones, or anything else used to identify the side limits of the opening 80.

The crossbar 60 identifies the upper limit of the opening 80. The crossbar 60 and the posts 50 may be constructed from different components and fused together with fasteners, welding or snap joints; or it may be formed from a single material that is shaped in form of an overturned U, or in overturned square or any other geometric shape.

The width 90 of the opening 80 should preferably be between 3.5 inches and 12.5 inches, with the overall length 95 of the crossbar 60 being between 5 inches and 15 inches. Overall length 95 refers to the width 90 measured together with the width 57 of each post 50. The width 57 of the posts 50 and the thickness 67 of the crossbar 60 should preferably be between one half of an inch and one and a half inches. However, the precise width 57 of the posts 50 and the thickness 67 of the crossbeam 60 are not as critical, but merely preferred, so as to increase the structural integrity of the goal enclosure 40 and to facilitate the bounce-off quality of the lobol 110 or ball 120. Alternatively, any size of the goal enclosure 40 may be acceptable; as long as the height 100 is capable of admitting the lobol 110 of a preferred diameter and the width 90 may admit at least two lobols 110, side-be-side. The bottom surface 55 may contain frictional elements, such as spikes, rods or ribs (not shown) for a more secure connection with the ground or other playing surface.

The back wall 70 or the top wall 65 may be made from solid materials, as shown, or may be made out of netting, rubber, resin or fabric. The primary purpose of the back wall 70 is to retain the lobol 110 that has entered into the goal enclosure 40, but may be omitted in alternative embodiments.

FIGS. 4A-4D illustrate a preferred set of equipment for playing the game embodied in the present invention that may preferably be included in the preferred game kit. Alternatively, each item may be contained on its own. Shown are a lobol 110, a ball 120, corner limits 130, and a pointer 160. The lobol may be a ball that is preferably be between 2 and 3 inches in diameter. It may be preferable that the lobol may be made out of materials that are highly resistant to cracking, such as, phenolic resin. However, other plastics and resins such as polyester and clear acrylic may also be used, as well as wood, metal, rubber, silicone, ABS, Polycarbonate, Noryl™, PVC, Polystryrene, ABS/PVC, PVC/Acrylic, Polysulfone, or a composite of these or other materials. The lobol 110 may be used interchangeably with a cue ball from billiards. The present invention intends the use of only one lobol 110 that is used by both teams in opposition to each other. Alternatively, the lobol 110 may also be embodied in a disk or a puck (not shown), or any other object that may be easily propelled along when hit by a transitory object.

The ball 120 should preferably be between 3.5 and 6 inches in diameter. It may be highly preferable that the ball 120 is not able to enter the opening 80 of the goal enclosure 40. A preferred ball should be springy, elastic and contain a mass of at least one half of a pound. The ball 120 may be hollow and filled with air or other gas, or it may be solid to create additional mass. The preferred materials for the ball 120 may be a Poly-Resin composite, rubber, silicone, plastic, polyester or a different polymeric substance, or a composite material. A good example of a ball 120 is a Bocce ball. Some Bocce game equipment or billiards game equipment may be applied to the present invention, for convenience.

The present invention preferably contains two teams with one player each. However, each team may have additional players depending on the size of the playing field 10. Preferably each player has at least four balls 120 at his or her disposal during play. However, this number may be increased or decreased depending on player preference or the total number of available balls 120. It may be preferable that the balls 120 included in the game kit are of at least two distinct colors. For example, there may be four Red balls 120 and four Blue balls 120. Other colors, color schemes, or designs may be used. This way it may be easier to distinguish which balls 120 belong to each player or team, and which are used defensively or offensively at that particular point of play. The player in possession 210 of the lobol 110 would use the balls 120 in an offensive fashion, by throwing them at the lobol 110, at each other, or at the opponent's balls 120. The player or team not in possession of the lobol 110 passively defends against such throws by relying on the positioning of its balls 120, in the hope that a strategically located ball 120 may deflect or block an offensive ball or a lobol 110. Therefore, most successful players or teams engaged in the sport embodied in the present invention must use offensive strategy that takes into account defensive needs.

It is preferable that a crease area 200 is clearly defined. The crease area 200 is an area immediately in front of the opening 80. A defensive ball 120, or a goalie, may be placed there in an effort to prevent a lobol 110 from entering into the goal enclosure 40. The depth 202 of the crease area 200 may preferably be between three and six inches, while the width may be equal to the width 90 of the goal enclosure 40. The crease area 200 may be square, or elliptical. The crease area 200 may be wider or narrower than the width of the opening 80.

The pointer 160, also referred to as a portable pointer, may be shared between players or may be issued to each team or to individual players. The pointer 160 may preferably be constructed from telescopic sections, such as in case of a radio antenna. The pointer 160 may be between 4 inches and 4 feet in length. The pointer 160 has several functions in the present invention. It may be used to measure the faceoff area, so that all players are properly spaced, or it may be used to measure the spacing of player's feet positioning prior to a throw. The pointer 160 may also be used to clear offensive balls 120 from in front of the goal opening 80, also referred to as the goal crease area. The pointer 160 may also be used to crease out any defensive balls 120. Preferably there may only be one goalie ball 120 in the crease area at any time during play. However, additional defensive balls 120 may be propelled or may roll into the crease area 200 inadvertently. A defensive player may choose which of the defensive balls 120 should be removed, or creased out, from the crease area 200, to reduce the final number of defensive balls 120 to one. During the game, it is not permitted to make a direct contact with the goalie ball 120.

Therefore, the only way to jostle the goalie out from in front of the goal is to make a throw, which results in moving the goalie.

The pointer 160 may be used for this function as well. The pointer 160 may be a solid or a hollow piece of pipe, conical pointer, or a solid rod. It may be telescopic or of static length. The pointer 160 may be made of any previously mentioned material, or of any material commonly used to manufacture, pipes, rods.

Some of the field markers may be sections of rubber, silicone or fabric and used to designate goal crease area, faceoff area or any other area that is significant to the game. The field markers 150, side limits 140 or corner limits 130 may also be painted with a special roller device that would apply paint to designate these elements of the playing field 10. All of these items may be included in the kit for the present game, or in a separate or auxiliary kit. However, any or all elements may be designated from makeshift items such as branches, rocks and other available materials. The preferred game kit may contain four red balls 120 and 4 blue balls 120, or any other color combination. The game kit may further contain one lobol 110, two goal enclosures 40, four corner flags 135, 4 rope boundaries for side limits 140, one midfield marker 30 and one pointer 160. Other, additional or replacement items may also be included in a typical game kit embodied in the present invention.

Figure 5:
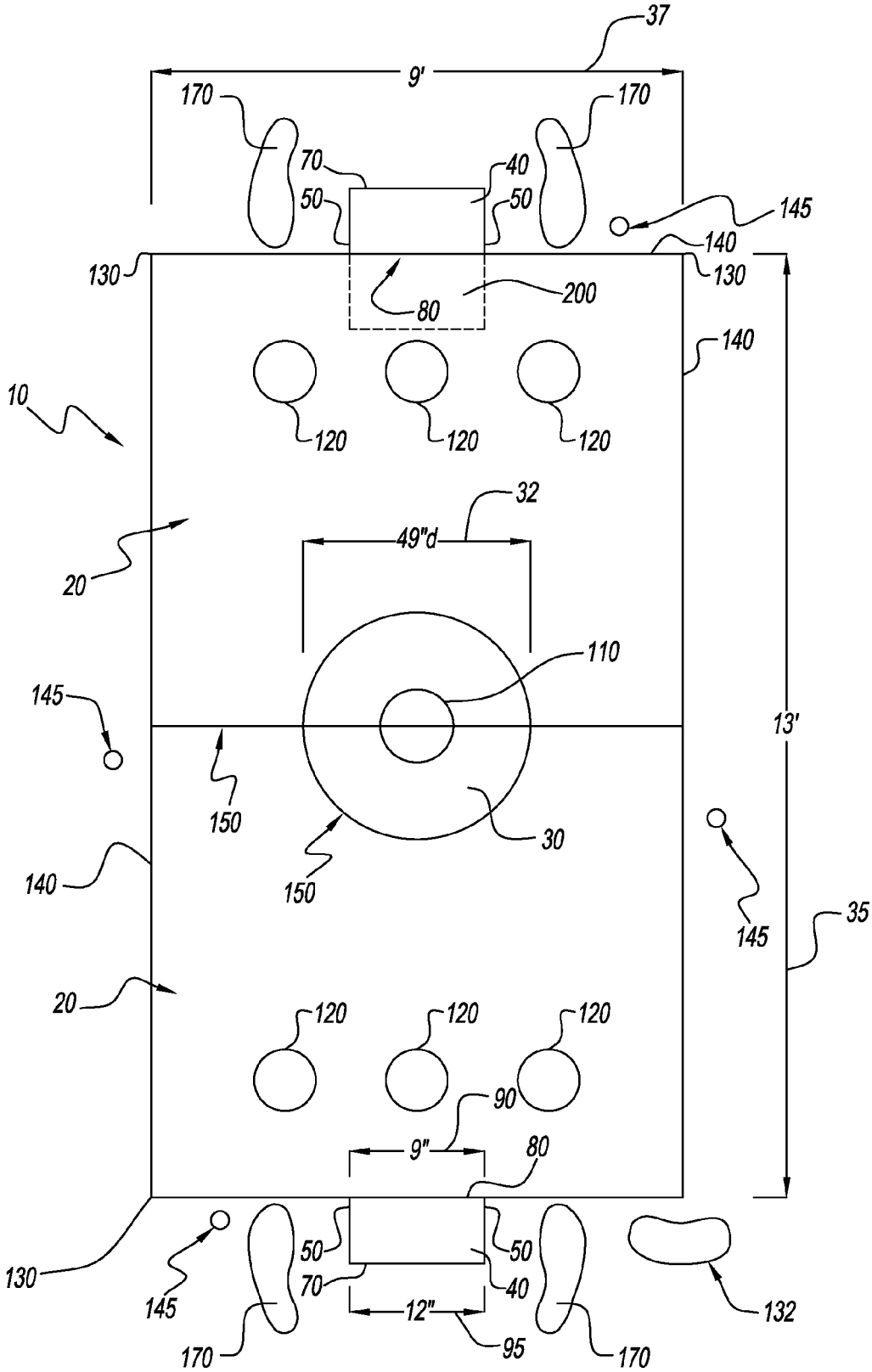
FIG. 5 is a diagram of the preferred playing surface with preferred equipment in place.

FIG. 5 is another view of the playing field 10 also known as the lobol pitch. The playing field 10 is shown with preferred equipment placed in an archetypical order at the start of play. Shown are a playing field 10, playing field half 20, a midfield marker 30, a width of the midfield marker 32, a field length 35, a field width 37 a goal enclosure 40, posts 50, a bottom surface 55, a post width 57, a cross bar 60, a top of goal 65, a back wall 70, an opening 80, a width 90, an overall width 95, a height 100, an overall height 105, a lobol 110, a ball 120, corner limits 130, location of feet for a corner throw 132, side limits 140, a field marker 150, a pointer 160, and location of player feet 170. At the start of play, a player may place his or her feet 170 around his or her respective goal enclosure 40 with one the fourth or additional ball 120 held in one's hands. On the count or three or upon expiration of a different timing designation, both teams cast their balls 120 at the lobol 110 that may preferably be located on the midfield marker 30. First possession or the right to the next throw is preferably awarded to the player or team whose ball 120 propels the lobol 110 forward. If both opponents manage to propel the lobol 110, or if neither is able to, possession may be awarded to the opponent whose ball 120 ends up closest to the lobol 110. Possession preferably identifies the right to propel one's balls 120 at the lobol 110 or at one's other balls 120. Missing either, forcing either out-of-bounds, or scoring a goal point terminates possession. It may be noted that if the lobol 110 ricochets out-of-bounds off of an opponent's ball, possession is retained, unless an opponent's ball 120 is also forced out of bounds.

To utilize the present invention at least two players begin by designating a playing field and setting up at least one goal enclosure. The step of designating a playing field preferably includes additional sub steps described in this paragraph. Initially, an area preferably between 9 and 18 feet in width and between 13 to 26 feet in width or any other size area may need to be located for use as the lobol pitch. The area may preferably be substantially flat and preferably be free of obstacles, either natural or man made. The area may be indoors or outdoors. Once such area has been located, the side limits 140 are set up. Preferably one rolls out a length of rope for the entire perimeter or four separate segments of rope or cordage that combine to form a perimeter. The corner limits 130 are preferably marked with flags 135, or any other designation. A separate length of rope, paint, chalk or any other available material may be used to mark designate the midfield line, if one is desired. A midfield marker 30 is then placed in the middle of the playing field 10 with the lobol 110 placed on top of the midfield marker. The lobol 110 may alternatively be placed anywhere else on the playing field or in the out of bounds area 145. Optionally, the players may also set up a cross-field marker, which may be a line or another point of orientation that may device the playing field 10 into two halves 20.

The goal enclosure may then be preferably disposed at an edge of said playing field, meaning the opening 80 of the goal enclosure 40 may be placed directly at, below, on top of, or near the side limit 140 that preferably designates the width 37 of the lobol pitch or playing field 10. A lobol 110 is preferably placed within the playing field 110 as mentioned above. The disclosed game requires that at least two teams are designated, each said team having at least one player or teams of players. The balls 120 of the same color are then designated for use by one team, with another color or designation for use by the opposing team.

Preferably, three or more balls 120 from each team are set up in front of an opening 80 of the goal enclosure 40 assigned to the each team. Of the contingent of balls 120 assigned to each team or player, one may be kept in front of the opening 80 at all times for the purposes of goaltending or as a goalie. The goaltending ball may be replaced back into position if knocked away, and may immediately be put back into position following a faceoff. The fourth or extra ball is picked up by each player with one player from opposing teams placing their feet 170 around the goal enclosure 40. If additional players or balls 120 are included in the game, the playing field would preferably need to be enlarged proportionally and then equipment may be arranged in a similar fashion or in a different fashion, depending on player preference. The step where each said ball is taken by a player describes the player lifting the fourth, the last, the extra or the only ball 120 prior to a faceoff. The casting of this ball 120 for the purpose of the faceoff, or at any time during the game, may be done in an underhanded, over-handed, one-handed, dual-handed, or a chest-pump fashion, or in any other agreed to or otherwise preferable fashion, or by rolling the chosen ball 120. It should be noted that balls 120 may be replaced by other objects, such as pillows, horseshoes, rocks, pellets, arrows or a flow of liquid, or any other object that can be cast in order to strike and thereby propel a stationary object.

The two players or two teams begin play about their own goal enclosure 40 and attempt to propel their ball 120 towards the lobol 110, until said lobol 110 crosses into the opposite goal enclosure 40 that is assigned to the opposing team. Once the lobol 110 enters into the goal enclosure, the opposing team or player is awarded a goal point. At this point the play returns to the step of designating the setup area to an extent that at least 3 balls 120 are again placed unto the pitch 10, the lobol 110 is returned to a faceoff position, balls 120 are placed in their pre-faceoff positions and the players or teams assume their pre-faceoff stance. At this point, opponents may switch sides 20. Alternatively, the player or team against who the goal point was scored gains possession of the lobol 110 at or about his goal line.

The balls 120 are propelled by first placing feet of a player throwing on same axis with respect to the ball 120 being thrown, or being identified as the ball to be thrown. The same axis preferably means that feet may be placed at any distance from the chosen ball 120; however, there must be an imaginary line drawn from one part of the foot through the ball 120, and terminating at the same part of the other foot. A player may utilize the pointer 160 to ensure or enforce this rule. Once a ball 120 is lifted to be thrown or rolled by a player or a member of the team, the player throwing or rolling must immobilize his or her feet until the throw or roll has been initiated. The player may immediately move any obstructing limb or lift his or her feet upon release of the chosen ball. However, a throwing player may lean or crouch prior to the throw. The game progresses towards the score of a goal point as players propel the lobol in the direction of one goal enclosure 40 or towards the opposite goal enclosure 40, by direct or indirect strikes from the thrown balls 120. An indirect strike or hit would occur if a player throws his or her ball 120 at another ball adjacent to the lobol 110, or at a line of balls that are adjacent to the lobol 110, in hope of causing a domino effect that culminates in the lobol 110 being propelled to a different location, preferably into the goal opening 80. The caveat of any ball throwing is that a penalty may be assessed if the lobol 110 or if any of the opposite team's balls 120 are propelled out of bounds 145 by the thrown ball 120.

As stated above, possession of the lobol may be determined after a faceoff win. The team or player awarded with possession then becomes the team or player to propel the next ball 120. It is preferable that at this point teams alternate in propelling said lobol, meaning opposing players or teams take turns in propelling the lobol 110 with throws by balls 120 that are assigned to them. However, the team or player currently in possession of the lobol 110 may retain possession of it as long as the ball being thrown strikes the lobol 110 or one of the balls 120 assigned to the same team, without forcing the lobol 110 or any of the opposing team's balls 120 out-of-bounds.

The preferred alternating propulsion of balls 120 may lead to a game match of substantial length if neither team is able to propel the lobol 110 into the opponent's goal enclosure 40 before the adversary attempts the same in the opposite direction. Therefore, penalty assessment or inducing penalties, as well as precise ball casting may be one of the keys to scoring points or winning a match. Alternatively, the balls 120 may be thrown simultaneously or in any other predetermined order. Furthermore, for multi-player team matches played over larger pitches, a sequence of throwing by the same or several teammates may be more desirable, followed by an equivalent sequence of throwing by the players of the opposing team.

To slightly complicate the disclosed game, the present invention preferably includes a rule that a ball 120, used for the present propulsion of the lobol 110 cannot be the ball 120 used for any immediate prior propulsion. Meaning a player or team must rotate balls 120 from one turn to the next, which requires strategizing to achieve the best possible ball positioning for the immediate next throw or series of throws. In other words, if a player has ball 1, 2, 3 and 4, and he makes a throw with ball #1, his or her next turn would have to be made by using balls 2-4. This player may go back to using ball #1 for the following a subsequent throw and so on. A throwing player may throw a ball 120 at the lobol 110, at another ball 120 or for better positioning of the ball being thrown. Penalty may also be assessed if one of player's balls 120 ends up in the out of bounds area 145 because of his or her own ball casting actions, thus terminating possession for that player. This may be highly disadvantageous to the player since the out-of-bounds ball 120 now needs to be in-bounded after the opponent's possession terminates. On an inbound throw, the player may hit the lobol 110, unless the out-of-bound ball was the last ball used in the prior possession.

As stated above, a play with penalties may be highly preferable to improve the dynamic of the game, since it forces the situation where a player or team not having any balls 120 in a strategic alignment with the lobol 110, may find itself the beneficiary of an out-of-bounds throw that may be extremely advantageous or that may lead to a goal point on the next or subsequent throw. For example, if a player "A" throws his red ball 120, and hits a blue ball 120, belonging to an opponent "B" and propels it out of bounds, the opponent "B" regains possession of the lobol 110 and may immediately throw the out of bounds ball back inbounds. In doing so, the player "B" may aim for the lobol 110 or one of his own blue balls 120. Player "B" may aim at the lobol 110 as long as the out-of-bounds ball being thrown was not the last ball used in the immediate prior possession by player "B". The same inbounding rules may apply if more than one ball belonging to player "B" was forced out of bounds by player "A". Inbounding rules may apply individually to each such ball, however, player "B" may have the discretion of choosing which ball to inbound first. For example, to inbound a ball 120 that was not the last used ball. Even if the player "B" misses both the lobol 110 and one of his blue balls 120, he or she still has another throw that may cause them to score a goal or to retain possession of the lobol 110. If the blue ball 120 that player "A" forced out of bounds, was not the ball thrown in an immediate prior possession by player "B", player "B" may throw this ball at a lobol 110 and may then use a different blue ball 120 to hit the lobol 110, and still retain possession.

It should be noted that forcing an opponent's ball 120 or the lobol 110 out-of-bounds, results in a penalty where the penalized player or a team looses possession of the lobol 110 and the opponent regains possession along with any additional throws. Where an opponent's ball 120 goes out of bounds as a direct result of being hit by an offensive ball 120, the player or team in possession is deemed to have caused the opponent's ball 120 to go out-of-bounds, and is therefore penalized. The thrower is also penalized if the opponent's ball 120 is hit, and as a result bumps into a second opponent's ball 120, forcing the second ball in this chain out-of-bounds. The result is that the thrower's possession terminates, and the defensive player will then get a chance to throw the out-of-bounds ball 120 back into the pitch 10. Penalties are not enforced during or as a result of face-offs, or when the lobol 110 forces a player ball 120 out-of-bounds.

For fairness sake, the knocked out ball 120 should be placed in an area where it rested prior to being knocked out-of-bounds. A penalty for forcing a lobol 110 out-of-bounds is preferably assessed to the team or player whose ball 120 was last hit by the lobol 110 prior to going out of bounds. Therefore, in the example above, if player "A" propels a lobol 110 forcing it to hit a ball belonging to player "B" and ricochet out of bounds, it is player "B" who is penalized, since the ball of player "B" caused the lobol 110 to go out-of-bounds. Thus player "A" would retain possession in this scenario. Therefore, player "A" may constantly attempt to knock the lobol 110 out-of-bounds by hitting it against balls 120 belonging to player "B". However, this would be very difficult to execute on a consistent basis, without also forcing the opponent's ball out-of-bounds, and thereby incurring a possession terminating penalty.

During the game embodied in the present invention, a posture of a throwing player is important. In-field posture includes immobile feet prior to a throw. However, crouching or leaning is preferably permitted. All in-bound throws, or throws into the playing field 10, from an out-of-bound position 145 may be referred to as an out-of-bounds posture. Several out-of-bound postures may be used, including legs at an angle and crouching, legs together and not crouching, and legs apart and crouching. As will be mentioned in further detail, legs apart and crouching posture may be used for throws from behind the goal enclosure 40; legs at an angle and crouching may be used for corner throws, and legs together and not crouching may be used for in-bound throws in all other penalty cases. It should be noted that when a crouching posture is available, it is not required.

Since an out-of-bounds situation may be significantly favorable to the opponent, the rules of the present invention limit effectiveness of out-of-bounds throws by requiring that the player in-bounding positions his or her legs into a stiff posture, also referred to as an out-of-bounds posture, during the propulsion of the inbounded ball or the lobol 110 back into the playing field 10. A stiff or an out-of-bounds posture includes not being able to bend one's knees or spread one's legs during a throw. Normally, knee bending, leg spreading, crouching and leaning are permitted for a regular ball throw within the limits 140 of the pitch 10. Another limitation is that a ball 120 or a lobol 110 that is only halfway over the side limit 140 or over the goal line side limit 140 is preferably still considered in-bounds and not a goal point.

The present invention also provides for a corner throw-in. For example, referring to the example above, if player "A" throws a red ball 120 and it ricochets off of a blue ball 120 and goes out-of-bounds over the side limit 140 that also serves as a goal line for player "B". Player "A" may maintain possession, by throwing the ricocheted ball back inbounds at the lobol 110 or at a red ball 120 from either corner 130 of the side limit 140. When making a corner throw, it is preferably to make an angle with one's feet, as shown in item 132. A player may not crouch when making a corner throw-in. Other inbound throws are preferably made from the side limit 140 or along the side limit 140 where the out-of-bounds occurred and crouching is not permitted. Note that leaning before a throw is permitted for throws or rolls originating from within the playing field 10. Leaning for a throw-in is permitted so long as the knees are locked and feet are close together.

If player "A" throws a red ball 120 and causes the lobol 110 to go over the side limit 140 serving as a goal line of player "B", but does not actually enter the goal enclosure 40, player "B" may throw the lobol 110 back in-bounds from behind his or her goal enclosure 80, and in this case crouching may preferably be permitted. Another out-of-bounds situation that deserves a mention is a when player "A" throws a red ball 120 at the opponents goal enclosure 40. However, the throw goes wide of the enclosure, and crosses the side limit 140 that serves as the opponent's goal line. Player "A" is penalized by loosing possession. Player "B" begins possession from behind his or her goal enclosure 40, notwithstanding the actual out-of-bound location of the ball thrown by player "A". Crouching is preferably permitted for this throw as well.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A method of playing a game, comprising the steps of:

providing a lobol, said lobol being substantially spherical in shape, substantially evenly weighted, having a size in a range between 2 and 3 inches in diameter and comprised of a hard, substantially unyielding material;

providing at least one ball, said ball being substantially spherical in shape, substantially evenly weighted, having a size in a range of between 3.5 and 6 inches in diameter, and comprised of a resilient, but yielding material; providing at least one goal enclosure, said goal enclosure having an opening sized to admit said lobol, but not said ball;

designating a starting point distant from said goal enclosure;

designating a first player as being player in possession of said lobol;

placing said lobol on a playing field between said designated starting point and said goal enclosure; propelling said ball towards said lobol, by said player in possession, with the intent of making said lobol move towards said goal enclosure; and, dependent on an outcome of said propelling, performing one of the following steps:

a: if said ball misses said lobol, designating another player as being player in possession, and repeating said step of propelling;

b: if said ball hits said lobol, and said lobol enters said goal enclosure, scoring a goal to said player in possession and repeating said steps from designating a first player as being player in possession of said lobol; and c: if the ball hits said lobol, but said lobol does not enter said goal enclose, repeating said step of propelling.

2. The method of claim 1 wherein designating a first player as the player in possession further comprise participating in a faceoff, said faceoff comprising:

placing said lobol on said playing field;

positioning said first and said another player substantially equidistant from said lobol and at substantially 180 degrees apart from each other;

substantially simultaneously propelling one of said balls by both said first and said another player, towards said lobol;

designating one of said first and said another player as said player in possession according to the following logic: whichever of said players propels said lobol into one of said goal enclosures;

else, whichever of said players propels said lobol further away from themselves;

else, whichever of said players' balls lands closest to said lobol.

3. The method of claim 1, further comprising the steps of; designating said playing field by marking at least a part of a perimeter of said playing field and by marking a center point of said playing field; setting up at said goal enclosure at an edge of said playing field; designating two teams, each said team having at least one player; and designating at least two balls, each of said balls being taken by a player.

4. The method of claim 3 further comprising placing at least 3 balls unto said playing field.

5. The method of claim 1, further comprising the steps of: setting up at least one limit for said playing field; setting up a mid-field marker; and setting up at least one cross-field limit; and placing at least one goalie in front of at least one goal enclosure.

6. The method of claim 5, further comprising the steps of: placing feet of said player on same axis with respect to said ball; immobilizing feet of said player during propulsion of said ball; determining possession of said lobol after a faceoff win; propelling said lobol by direct hits from said balls; and propelling said lobol by indirect hits from said balls.

7. The method of claim 1, further comprising assessing penalties.

8. The method of claim 7, wherein a penalty is assessed to said player when his ball causes a lobol to be propelled to an out-of-bounds area.

9. The method of claim 8 wherein a penalty is assessed to said player who causes said opposing player's ball to be propelled to an out-of-bounds area.

10. The method of claim 9 further comprising of using one of said balls to propel a lobol when said ball was not used in an immediately prior propulsion.

* * * * *